US006119313A

United States Patent [19]

Göhler

[11] Patent Number: 6,119,313

[45] Date of Patent: Sep. 19, 2000

[54] APPARATUS FOR THE MANUFACTURE OR FINISHING OF FIBER BAND

[75] Inventor: Wolfgang Göhler, Lenting, Germany

[73] Assignee: Rieter Ingolstadt Spinnereimaschinenbau AG, Ingolstadt, Germany

[21] Appl. No.: 09/041,317

[22] Filed: Mar. 12, 1998

[30] Foreign Application Priority Data

Mar. 14, 1997 [DE] Germany ..... 19710530

[51] Int. Cl.[7] ..... D01G 15/40

[52] U.S. Cl. ..... 19/105; 19/150; 19/157; 33/501.02; 226/187; 364/470.13

[58] Field of Search ..... 19/105, 237, 239, 19/240, 236, 360, 106 R, 0.23, 0.24, 157, 150, 159 A; 57/315, 412; 364/470.13, 470.14; 33/501.02, 710, 711, 732, 734; 73/159, 160; 464/78, 88, 89, 162, 153, 154; 226/187; 26/101, 102, 103, 104

[56] References Cited

U.S. PATENT DOCUMENTS

| | | | |
|---|---|---|---|
| 2,681,552 | 6/1954 | Olson | 464/153 |
| 3,132,494 | 5/1964 | Hoffer | 464/154 |
| 3,328,851 | 7/1967 | Whitehurst | 19/157 |
| 3,409,947 | 11/1968 | Whitehurst | 19/236 |
| 3,443,282 | 5/1969 | Dixon . | |
| 4,411,634 | 10/1983 | Hammelmann | 464/88 |
| 4,646,387 | 3/1987 | Oswald . | |
| 4,839,944 | 6/1989 | Hollingsworth et al. | 19/240 |
| 5,237,754 | 8/1993 | Oexler | 33/501.02 |
| 5,375,958 | 12/1994 | Kluttermann | 19/159 A |
| 5,452,626 | 9/1995 | Denz . | |
| 5,564,982 | 10/1996 | Gipson et al. | 464/88 |
| 5,606,509 | 2/1997 | Denz . | |
| 5,799,374 | 9/1998 | Strobel et al. | 19/236 |

FOREIGN PATENT DOCUMENTS

| | | |
|---|---|---|
| 888819 | 6/1953 | Germany . |
| 1059322 | 6/1959 | Germany . |
| 1221936 | 7/1966 | Germany . |
| 19538496 | 2/1997 | Germany . |
| 2062037 | 5/1981 | United Kingdom . |

OTHER PUBLICATIONS

German Patent Office Search Report, Aug. 11, 1997.

Bedeutung Der Faserbandvergleichmässigung Für Die Garnqualität, Dr.–Ing. Burkhard Wulfhorst, Dipl.–Ing. Walter Friebel., Melliand Textilberichte–Feb. 1986.

*Primary Examiner*—John J. Calvert
*Assistant Examiner*—Gary L. Welch
*Attorney, Agent, or Firm*—Dority & Manning

[57] ABSTRACT

In regard an apparatus for the manufacture or finishing treatment of a fiber band (31), such as, for instance, a drawing frame or a carding process, the fiber band (31) is conducted between two feeler rolls (6, 6'). The feeler rolls (6, 6') are adjustable in a radial direction to achieve a set distance of separation for the measurement of the fiber band thickness. At least one of the feeler rolls (6, 6') is driven by a shaft. The shaft is composed of a drive shaft (15) and a feeler roll axle (16). The feeler roll axle (16) is connected to the drive shaft (15) by means of a shaft misalignment tolerant coupling (1).

20 Claims, 3 Drawing Sheets

APPARATUS FOR THE MANUFACTURE OR FINISHING OF FIBER BAND

BACKGROUND OF THE INVENTION

The invention concerns an apparatus for the manufacture or finishing of a fiber band, such as for a drawing frame or a carding process, wherein the fiber band is conducted between two feeler rolls. The feeler rolls are adjustable in a radial direction to achieve a preset distance of separation for the measurement of fiber band thickness, and at least one of the rolls is driven by a shaft.

An apparatus of this class, such as, for instance, the Regulier drawing frame RSB 951 of the firm Rieter Ingolstadt Spinnereimaschinenbau AG, shows for the measurement of the thickness of the fiber belt, a pair of feeler rolls, which are variable in their spatial interval, one from the other. The fiber band which is conducted through the feeler roll pair activates the distance of the one feeler roll from the other more or less in accord with the thickness of the fiber band. The rolls, which are pressed against each other by means of springs, follow the varied thicknesses of the fiber band which is between them. The fiber band thickness which has been so registered, is transmitted to the control of the machine or at least brought to a display. By means of the determination of the fiber band thickness, the manufacturing procedure can be improved, in that a fiber band with an extremely even thickness can be made, when the machine is operated in adjustment, that is, in the chosen stretch of the fiber band. Pairs of feeler rolls of this kind are found on the input side and/or on the output side of a drawing frame. At the drawing frame entrance, the thickness of the fiber band which is on the point of entering the frame is measured. In accord with this measurement, single drawing frame pairs of rolls are more or less accelerated, so that too thick a fiber band is reduced in thickness and a too thin a fiber band is less strongly stretched, whereby its thickness is increased. At the draw frame exit end, an additional pair of feeling rolls can be found, which are frequently called a pair of calender rolls. These determine the result of the drafted fiber band. At this point, a quality control operation of the extended fiber band is carried out.

These measurement based results can serve for statistic evaluation as well as also for an input to the regulation of the drawing frame.

Very often, a stationary feeler roll is arranged as one of a feeler roll pair. The second feeler roll is designed to be radially pivotable, in order that it may be disengaged in case of an uneven fiber band. The pivotable feeler plate is furthermore driven to avoid slip of the fiber band between the feeler rolls and thus, in an unfavorable case, to avoid a faulty draft of the fiber band.

In order to achieve especially good measurement results with a feeler roll pair of this description, it is important that the feeler rolls can quickly follow a fiber band of fast changing thickness. A detriment of the conventional embodiment is that the pivotable feeler plate and the drive mechanism are affixed to a pivotable bearing block. The complete assembly is relatively heavy and because of its high inertia, results in a relatively sluggish response reaction as the thickness of the fiber band changes. Even by modern equipment of this generic type and driven at very high loading rates, the changing fiber band thickness cannot be tracked with the required precision.

OBJECTS AND SUMMARY OF THE INVENTION

Thus a principal purpose of the present invention is to create a feeler roll pair, which even in the case of fast thickness changes of the fiber band, reacts with exactness and provides precise readings of the thickness of the fiber band. Additional objects and advantages of the invention will be set forth in part in the following description or may be obvious from the description, or may be learned through practice of the invention.

According to the invention, the shaft by which the feeler roll is carried is separated into a drive shaft and a feeler roll axle, and the two shaft sections are connected by a misalignment tolerant coupling. Thus, the deviation of the feeler roll occurs with a reduced weight. The feeler roll with its axle are deviated as well as the bearings thereof. A deviation then of the weight of the drive, the drive shaft, and the bearings thereof is not necessary. Thereby, a clear reduction of the moving weight is carried out by the measurement of the fiber band. Reproduceable changes of the fiber band thickness under these conditions are possible without great time delay because of large inertial forces. The measurement of the fiber band is accordingly very exact. The present invention realizes thereby a clear weight reduction of the moving components.

If the drive shaft and the feeler roll shafts are at least partially installed independently of one another, then advantageously there is no interference with the single, pivotable shafts.

If the shafts are arranged in individual, pivotable bearing blocks, then a deviation of the feeler roll is, from a technical standpoint, easily solved. By means of the pivoting of the bearing blocks, one feeler roll is radially distanced from the other. The separation occurs during the measurement of the fiber band. The magnitude of the distancing is in relation to the changing fiber band thicknesses. Advantageously, the two bearing blocks are so interconnected, that after a predetermined angular rotation of the roll bearing block, the drive bearing block likewise pivots. Thus it is assured that, for instance in the case of windup of the fiber band, that is, in an operational difficulty of the apparatus of the invention first, the roll bearing block is displaced up to a detent, whereupon the drive bearing block pivots. Damage to the feeler roll arrangement is thereby avoided, since the feeler roll can yield to the pressure of the fiber band.

Advantageously, in the case of windups of the fiber band, an eccentric thrust bar arrangement, which acts upon the drive bearing block, is released. When this occurs, the feeler roll pair becomes continually open and thereupon remains in this state. By means of the eccentric thrust bar arrangement, it is moreover possible to carry out cleaning operations or manually or to automatically feed fiber band between the two feeler rolls. Also, the feeler rolls can be opened by means of the eccentric rod and subsequently, following the insertion of the fiber band, the said rod again closes both of the feeler rolls.

It is especially of advantage if the roll bearing block is pivotably installed on the drive shaft bearing block. This leads, on the one hand, to simple construction, and on the other, to a more secure pivoting during the fiber band measurement as well as a means to open the feeler rolls upon a windup.

In order to be able to evaluate the different fiber band thicknesses, a displacement pickup is arranged on the drive bearing block. This pickup is arranged for the measurement of the pivoting of the roll bearing block.

Usually, a maximum spatial interval of 10 mm is sufficient between the feeler rolls with a corresponding pivoting allowance for said feeler roll blocks.

Sliding bearings, in which the bearing blocks are pivotally secured, bring about favorable friction relationships for the small dislocations of the measurement. This allows exact measuring of the fiber band. An adjustment of the feeler rolls is possible by means of an adjustment screw, which fixes the start point adjustment of the two feeler rolls to one another.

In order to make possible a further pivoting of the drive bearing block, it has been advantageously provided that a maximum distance between the feeler rolls of 30 mm can be reached. In order to be able to take off a windup of the fiber band from a feeler roll, 30 mm usually suffices. If the drive bearing block is pivoted to its maximum degree, then the drive bearing block acts upon a disconnect of the apparatus. In this way, it is assured, that no fiber band windup grows larger and leads to damage of the apparatus.

A design which has shown itself as simple and thus advantageous becomes evident when the bearing blocks are securable in their basic positions by means of loading springs. The basic start position means that the feeler rolls lie upon one another or show a gap therebetween of less than 0.5 mm, preferably 0.05 mm when no fiber band is present. In order to permit a deviation of the roller bearing blocks prior to the pivoting of the drive shaft bearing block, the spring acting on the roll axle block possesses a weaker characteristic curve than does the spring acting upon the drive shaft bearing block. In this way, the weaker spring expands first to its maximum extension and only after this does the stronger spring come into play.

A torsionally rigid, flexible shaft coupling between the drive shaft and the feeler roll axle has shown itself as particularly advantageous. By this means, a misalignment of the two shafts can be tolerated, but in any case torque is transferred to the feeler roll axle. Excellent results have been obtained by the use of a multiple disk coupling.

It is advantageous, for an exact measurement of the fiber band, if only small forces for the generation of a misalignment of the coupling are required. Under certain circumstances, forces which are too great react to produce a strong loading of the fiber band with subsequent erroneous measurement results. Beyond this, there are conditions within which too great an offset force would negate the savings which have been made in reducing the weight.

If the feeler roll axle is borne by needle bearings and is force fit on its axle, then a further weight reduction is brought about in regard to the pivoting components for the measurement of the fiber band, since the needle bearings are built very small and light, and by the force fit of the feeler roll on its axle, no additional constructional parts are needed.

A further reduction of the total weight of the feeler roll is achieved if the feeler axle is made hollow by axial boring. Thus, the feeler roll is designed to be extremely light. In addition, axial borings which reduce weight can be made in the feeler roll to reduce the inertia of the feeler roll and thus make possible a quick and precise measurement of the fiber band.

If the feeler roll possesses a concave, circumferential rim to accept the fiber band, then a guidance of the feeler roll is provided by the fiber band. This situation allows omitting an axial guide mechanism for the bearings of the feeler roll. Thus, at the same time, weight for the necessary components for such guidance can be eliminated.

It is particularly advantageous, if the drive shaft is driven by means of a toothed belt. This simple drive mechanism brings about a sufficiently exact speed of the feeler roll. In many applications, it is advantageous if the drive shaft is powered directly from a motor which is connected directly to the drive shaft.

An example embodiment of the invention is described in the following Figures.

DETAILED DESCRIPTION

Reference will now be made in detail to the presently preferred embodiments of the invention, one or more examples of which are illustrated in the figures. Each example is presented to explain the invention, and not as a limitation of the invention. In fact, features illustrated or described as part of one embodiment can be used on another embodiment to yield still a further embodiment. It is intended that the present invention include such modifications and variations.

Figure 1:
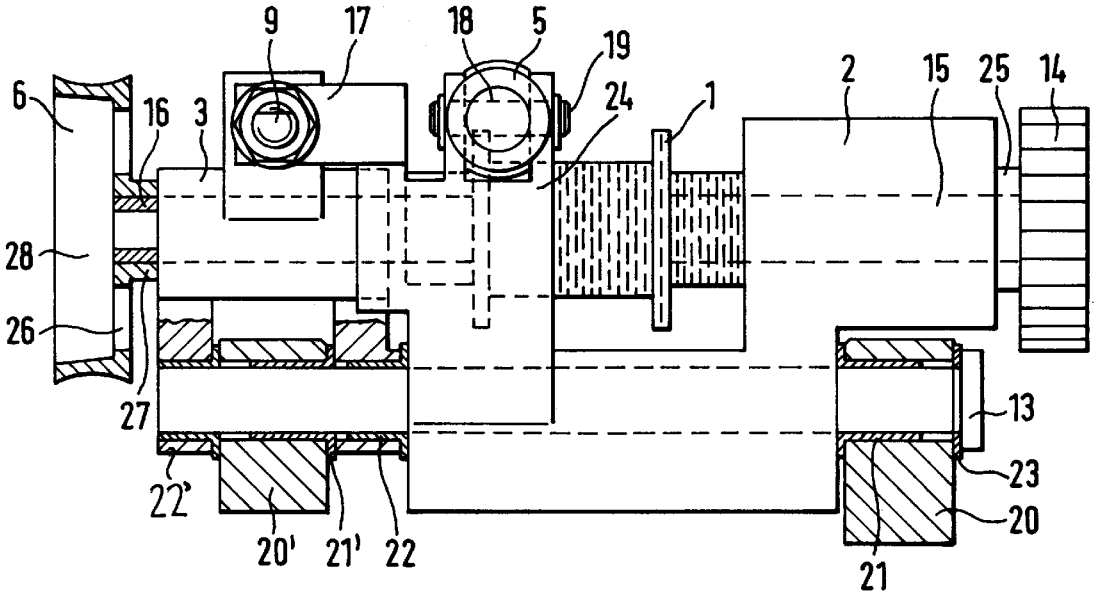
FIG. 1 is a side view of an apparatus in accord with the invention.

An apparatus, in accord with the invention, shown in FIG. 1 shows a coupling 1, which joins a drive shaft 15 with a feeler roll axle 16. The drive shaft 15 is rotatably secured in a bearing block 2. Likewise, the feeler roll axle 16 is rotatably secured in a feeler roll bearing block 3. The bearing provision is made advantageously with needle bearings, which are not shown. Needle bearings possess the advantage that they can be made very small. If space allowances permit, other kinds of bearings are permissible in the drive shaft bearing block 2. The drive shaft 15 is provided on one end with a toothed belt sheave 14. By means of a power mechanism not shown, driven toothed belts act on the toothed belt sheave 14, which turns the drive shaft 15, the coupling 1, as well as the roll axle 16 which latter carries a feeler roll 6 affixed thereto. Instead of the toothed belt, the drive can possibly be carried out by means of a flat belt, a chain, or another similar drive means. Moreover, the drive can be effected directly by means of a motor, the shaft of which being flangedly affixed to the drive shaft 15.

The drive bearing block 2 is secured on a swivel axis 13. The swivel axis 13 is set in bearings 20, 20', by means of bushings 21, 21' and with a washer 23. The sliding bushings 21, 21' of the swivel axis 13, as well as the washer 23, have shown that in a small construction space, the small axial displacement of the drive bearing block 2, to be later described, can be carried out very well. Axel 13 is set in bearing block 3 by means of bushings 22 and 22'.

On the drive shaft bearing block, a carrier 24 is installed. To this carrier 24 is affixed, by means of an axle 19, an eccentric bar 18, used as a tripping device. The lever bar 18 is comprised, in part, of a spring 5. Upon a rotary movement of the drive bearing block 2 by the swivel axis 13, the spring 5 is more or less strongly compressed.

This allows, to a prescribed extent, a pivoting of the drive bearing block 2. As soon as this prescribed measurement of movement is overstepped, the eccentric bar 18 kicks out and prevents a reverse springing of the drive bearing block 2 into the start position. This is advantageous if the entire unit pivots because of a windup around the feeler roll 6. In this case, the eccentric bar 18 pivots around the axle 19 and so acts that the drive bearing block 2 as well as the feeler bearing block 3 rotate into an end position and remain there. Customarily, it is foreseen that in this position a switch 35 (FIG. 4*c*) is activated which shuts down the machine, blocking the delivery of anymore fiber band.

On the drive bearing block 2 as well as the carrier 24, a pivoting lever 17 is provided. On this said pivoting lever 17, a positioning screw 9 is to be found which serves for the loading of the rolls. By means of positioning screw 9, that force is applied which is required to move the feeler roll 6 away from its paired feeler roll 6' by means of the fiber band. By the adjustment of the positioning screw 9, the spring force is increased or decreased.

This has the effect that more or less force is necessary in order to move the two rolls 6, 6' away from each other. This movement occurs by means of the fiber band which has been led through the two rolls 6 and 6', and which fiber band exhibits differing thicknesses. The more the positioning screw 9 compresses the spring 4 (FIG. 2), just so much earlier will a detent of the feeler roll bearing block 3 confront the pivot lever 17. When this occurs, a deviation of the drive bearing block 2 results by means of the spring 5. In this situation, since the spring 4 is weaker than the spring 5, it follows that first the spring 4 is compressed and then, only after complete compression of the spring 4, a deviation of the spring 5 occurs.

The feeler roll 6 is affixed to a roll axle 16. The roll axle 16 is furnished in this embodiment example as a hollow shaft. In this way, an additional weight reduction in the movable roll bearing block 3 is achieved. For yet a further reduction in weight, provision is made that the feeler roll 6 is force fit by means of a collar 27 on the roll axle 16. By means of the elimination of additional material for fastening, this further reduces the weight.

Likewise, to the purpose of weight reduction of the moving parts, feeler roll 6 is provided with a recess 28 as well as web borings 26. This assures that all the components installed on the roll bearing block 3 have been designed to be especially light, whereby a quick response to changes in the fiber band thickness is made possible for the feeler roll 6 which is secured in said bearing block 3.

The coupling 1 is designed in such a way that it is easily deflected, that is, it is tolerant of a misalignment but on the other hand, the torque, which is communicated by the driving means to the drive shaft 15, is transmitted in good order. The coupling 1 must therefore be stable for transmission of torque but yet permit a lateral offset of the drive shaft 15 upon a deflection of the feeler roll bearing block 3 of the roll axle 16. By means of a minimal restoring force from the coupling 1, the advantage arises that the weight reduction achieved in the movable bearing block 3 is not counteracted by an excessively high restoration force, compelling the drive shaft 15 and the feeler axle 16 into an aligned axle position.

The flexible shaft coupling 1, which has a torque transmitting rigidity, can be provided with two multi-disk packets, which, in the connection of two shaft ends, compensate for a radial shaft offsetting. The coupling is comprised of two multi-disk packets, two collars and a transition piece. Between the toothed belt sheave 14 and the drive shaft 15, a slip clutch is provided. In the case of a blocking of the feeler roll 6, for instance because of a windup of the fiber band around the feeler roll 6, the coupling would be damaged if the drive acting upon the toothed belt sheave 14 does not stop. The coupling is advantageously arranged to act from the drive bearing block 2 upon the drive shaft 15. Otherwise, if it were to act upon the feeler roll axle 16, an additional increase of pivoting weight due to the feeler roll bearing block 3 would result.

One of the essential thoughts in the case of the arrangement in accord with the invention is that the drive of the feeler roll and the feeler roll itself are at least partially uncoupled from one another.

Thereby, a displacement of the feeler roll 6 is allowable, without carrying along those components which are necessary for the drive of the feeler roll 6. By means of this weight reduction, a very exact measurement of the fiber band is made possible.

Figure 2:
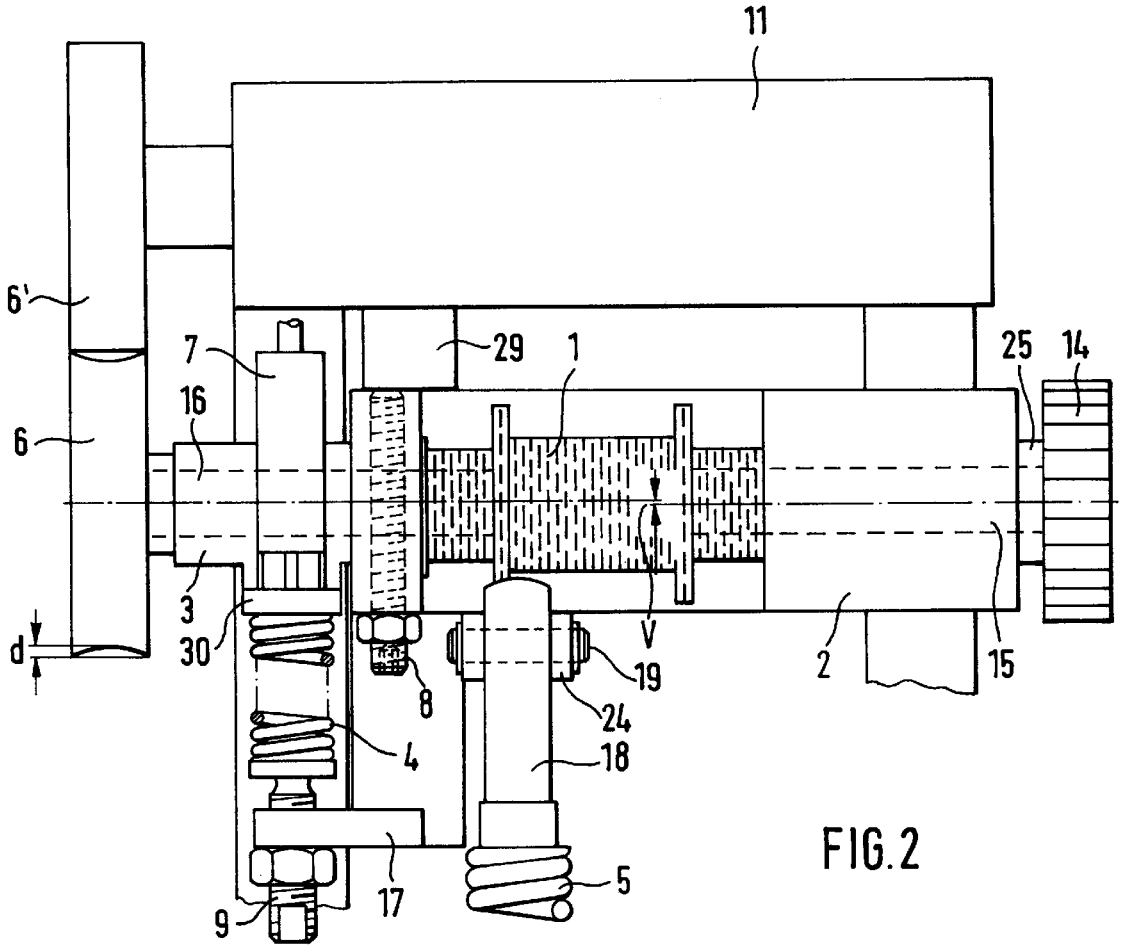
FIG. 2 is a plan view of an apparatus in accord with the invention.

FIG. 2 shows the apparatus in accord with the invention in a plan view. The toothed belt drive 14 is connected by means of a clutch 25 to the drive shaft 15. The coupling 1 is affixed to the drive shaft 15 as well as to the roll axle 16. The feeler roll 6 is installed on the roll axle 16. The circumference of the feeler roll is shown as a concave rim d . By means of this concave rim d, the circumstance arises that the fiber band found between the feeler roll 6 and the feeler roll 6' serves as an alignment guide for the one feeler roll 6. This allows that an axial securement of the bearing system of the feeler roll 6 may be eliminated. Thus no further components are necessary to fix the feeler roll 6 axially in its bearings. The preferably employed needle bearings for the support of the roll axle 16 can accordingly be used with very little additional weight.

A feeler plate 30 has been installed on the feeler roll bearing block 3. When the fiber band varies in its thickness between the feeler rolls 6 and 6', then the feeler roll bearing block 3 carrying the feeler plate 30 is also more or less pivoted. The pivoting works against the pressing action of the spring 4. The spring 4 is anchored on the positioning screw 9, which in turn is fastened in the pivot lever 17. By means of the adjustment of the positioning screw 9 the pressing action of the spring 4 is altered. Therewith, an influence is brought to bear on the force with which the fiber band is compressed between the two feeler rolls 6 and 6'. If there is no fiber band between the feeler rolls 6, 6', then the spring 4 presses the feeler roll bearing block 3 against a detent on the drive bearing block 2. The pivoting of the entire unit with the drive bearing block 2 and the feeler roll bearing block 3 is adjustable by means of a positioning screw 8 which presses against a spacer 29. In this way, the spatial interval between the feeler roll 6 and the feeler roll 6' is set. Usually, the adjustment is carried out in such a way, that in an empty condition, the feeler rolls 6 and 6' do not touch each other.

This is to assure that upon a long stillstand, the feeler rolls 6 and 6' do not press against one another and in this way contribute to measuring results which reflect erroneous pressure points. The detent for the position of the feeler roll bearing block 3 for the drive bearing block 2, in the state where no fiber band is found between the feeler rolls 6, 6', is planned in such a way that an offset V between the axes of the drive shaft 15 and the roll axle 16 arises, which is slightly negative. This is favorable for the restoration force of the coupling 1, since in the situation in which there is fiber band between the feeler rolls 6 and 6', the coupling 1 is less strongly pivoted, as would be the case in idling time, had no misalignment been purposely arranged.

The distance between the feeler rolls 6 and 6' is measured with the aid of the displacement pickup 7. The displacement pickup 7 is either stationarily fixed on a roll bearing housing 11 for the feeler roll 6' or is on the drive bearing block 2. By means of the turning of the feeler roll bearing block 3, the distance between the displacement pickup 7 and the feeler plate 30 changes. This change of the separating distance is proportional to the change of the thickness of the fiber band between the feeler rolls 6 and 6'.

As soon as (1) the spring 4 is completely compressed by means of a deflection of the feeler roll 6, which deflection could lead to damage of the equipment, or (2) the feeler roll bearing block 3 impinges against a detent on the drive bearing block 2, then the drive bearing block 2 itself will be deflected.

This deflection is made against the force of the spring 5. The spring 5 is of stronger design than the spring 4, so that in each case, the spring 4 is deflected for the measurement of the fiber band. By means of the deflection of the drive bearing block 2, the spring 5 is compressed. The spring 5 is integral with the eccentric bar 18, which in turn is pivotally supported by the axle 19 on the carrier 24. In the case of an extreme deflection of the drive bearing block 2, which can happen, for instance, by a windup around the feeler roll 6 or 6', the eccentric thrust bar 18 is disconnected and the entire movable component is brought into an end position wherein the feed of fiber band is halted. Only by means of manual intervention, can the drive bearing block 2 and the feeler roll bearing block 3 be brought back into their operating position by the eccentric bar 18, in which position the feed of new fiber band can be restarted.

Figure 3:
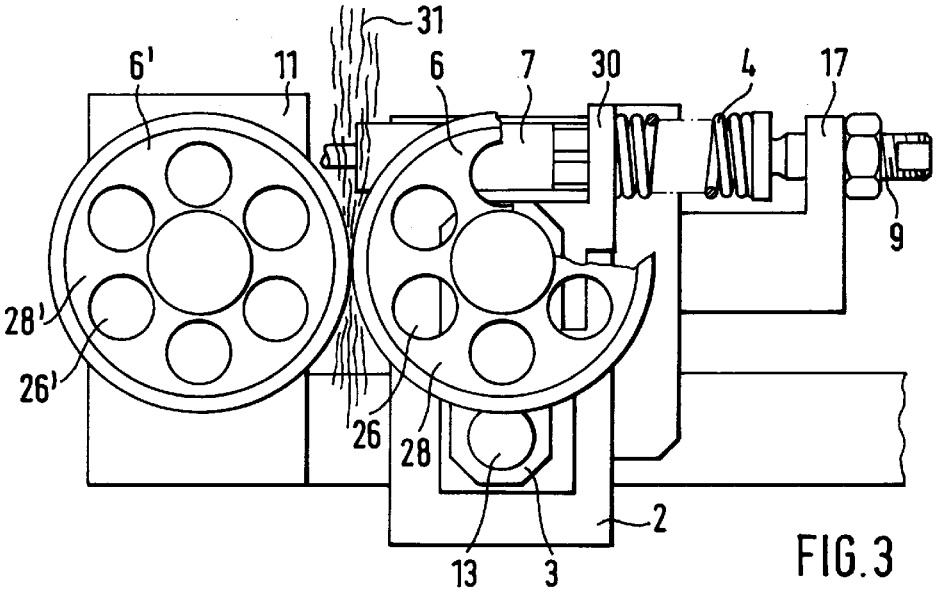
FIG. 3 is a front view of an apparatus in accord with the invention.

FIG. 3 presents a front view of an embodiment of the apparatus in accord with the invention. The feeler roll 6' is immovably installed in the roll bearing housing 11. The feeler roller 6' here exhibits borings 26', which reduces the weight of said feeler roll 6'. The feeler roll 6' can be designed without the borings 26', and not endanger the functioning of the invented apparatus as well as without the recess 28'. A weight reduction in the case of the feeler roll 6' is not so important, since in this case the measurement of the fiber band thickness is not dependent on a movable feeler roll. Contrary to this, in the case of the feeler roll 6, the borings 26 and the recess 28 are advantageous, since they contribute to the weight reduction of the feeler roll bearing block 3 and hence also to a precise measurement of the fiber band 31. The measurement of the thickness of the fiber band 31 is done in that the feeler roll 6, which is supported in the feeler roll block 3, pivots around the axis 13 when a change in the thickness of the fiber band 31 occurs. The feeler plate 30 is installed on the feeler roll bearing block 3. Upon the swivelling of the feeler roll bearing block 3, the feeler plate 30 moves against the force of the spring 4. As this is done, the feeler plate 30 more or less distances itself from the displacement pickup 7. This removal distance is transmitted from the displacement pickup 7 to an (not shown) evaluation unit of the apparatus. The transmitted signal is interpreted as the thickness of the fiber band 31 and serves for the determination as to whether or not the said thickness of the fiber band 31 lies within the allowable tolerances. The displacement of the feeler plate 30 works against the force of spring 4, which is adjusted by means of the positioning screw 9. The positioning screw 9 is affixed to the pivoting lever 17, which in turn is connected with the drive bearing block 2. As soon as the extended travel stroke of the spring 4 has reached its limit, or the feeler roll bearing block 3 impinges on the detent of the drive bearing block 2, the said drive bearing block 2 likewise turns about the axis 13.

As this occurs, the entire pivotable unit, which is essentially comprised of the drive bearing block 2, the feeler roll bearing block 3 as well as the feeler roll 6, moves away from the feeler roll 6' and can stop the feed of the fiber band 31. This is possible because either damage to the invented apparatus is threatened or the allowable tolerance for the thickness of the fiber band 31 has been overstepped. A stoppage of the feed to the machine can also come about if the deflection pickup 7 determines such an overstepping of the thickness tolerance of the fiber band 31. The allowable tolerance is communicated to the control of the apparatus. Only the feeler bearing block 3 together with the feeler roll 6 are exclusively pivoted for the measurement of the fiber band 31 within the allowable thickness tolerance range. Along with this, and contrary to the conventional state of the technology, a marked reduction in weight of the moving components has been brought about whereby the thickness of the fiber band can be determined with greater reproducibility. Thus, the variance of the fiber band thickness is determined and transmitted better than previously.

Figure 4C:
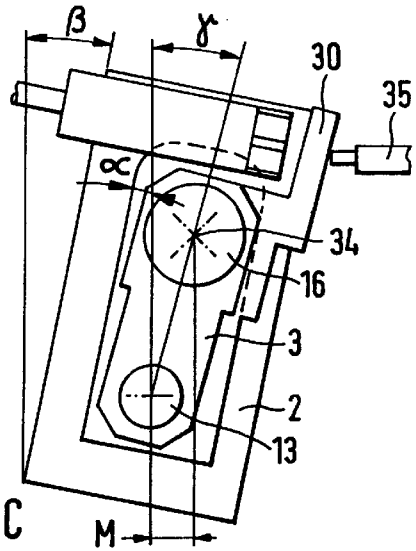
FIGS. 4*a* to 4*c* are different disengagements of an invented apparatus.
Figure 4B:
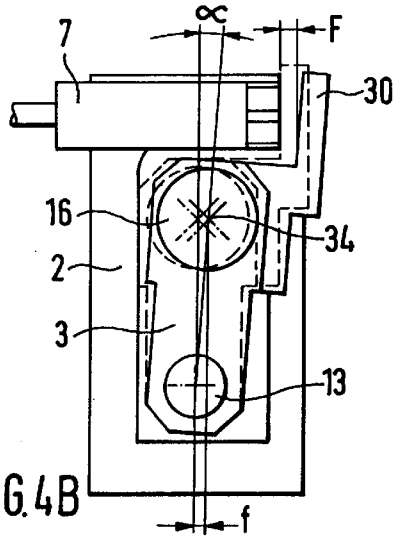
Figure 4A:
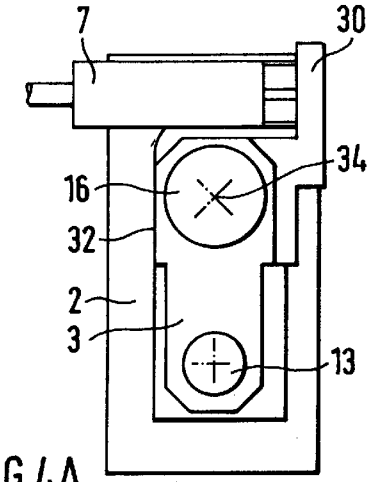

The FIGS. 4*a*, 4*b* and 4*c* show in a schematic manner, the drive bearing block 2 and the feeler roll bearing block 3 in various positions relative to one another. In FIG. 4*a*, the feeler bearing block 3 and the drive bearing block 2 are shown in their start position. The feeler roll bearing block 3 lies on a detent 32 of the drive bearing block 2. This position is customarily set up when the fiber band 31 finds itself between the feeler rolls 6 and 6'. The feeler bearing block 3, which is pivotable about the axis 13 and which carries the roll axle 16, is thus in its start position. The feeler plate 30, which is on the feeler bearing block 3, is in a specified position in regard to the displacement pickup 7 which is fastened to the drive bearing block 2.

FIG. 4*b* shows the deflection of the feeler bearing block 3 in a normal operation. The pivoting of the feeler roll 6 bearing block 3 occurs about the pivot axis 13. The pivoting is thereby achieved, in that the (not shown in FIG. 4*b*) feeler roll 6 which is carried by the roll axle 16, is moved away from the feeler roll 6' by means of the fiber band 31 which runs between the said feeler rolls.

In this way, there follows a pivoting of the roll axis 34 about the pivot axis 13 to the degree of angle $\alpha$. Something like 5° is seen as advantageous and sufficient for the angle $\alpha$. The displacement through angle $\alpha$ activates a lateral offset of the roll axis 34 through the distance f. This value f represents the maximal allowable measurement range for a change in the thickness of the fiber band. The value of about 2 mm has shown itself to be sufficient. Simultaneously with the drive bearing block 2, the feeler plate 30 which is fastened thereon, is displaced and moved away from the displacement pickup 7. Therefrom is developed a measurement travel F, which corresponds to a fiber band thickness. By means of the shape and the lever relationships which arise therefrom, among axis 34, pivot point 13 and feeler plate 30, an advantageous measurement travel F has arisen showing a value of 3 to 5 mm.

In FIG. 4*c*, the situation is presented, in which the feeler roll 6 is rotated out of the measurement zone. In this case, the drive bearing block 2 is likewise pivoted around the axis 13. In this position, the maximum separation M of the feeler rolls 6 and 6' occurs. This offset may amount to about 7 mm which is considered sufficient. The total divergence is approximately 15°. This total divergence $\gamma$ is comprised of the combined angles $\alpha$ and $\beta$. The angle $\alpha$ indicates the maximum deviation of the roll bearing block 3 in reference to the drive bearing block 2. The deviation $\beta$ shows the maximum possible deviation of the drive bearing block 2. The invented apparatus finds itself in the position of FIG. 4*c* whenever a windup occurs about one or both of the feeler rolls 6, 6' and the entire apparatus swivels into the idling state by means of the eccentric bar 18. A position of this kind can also be of value if the feeler rolls are opened in order to insert a new fiber band.

Figure 5:
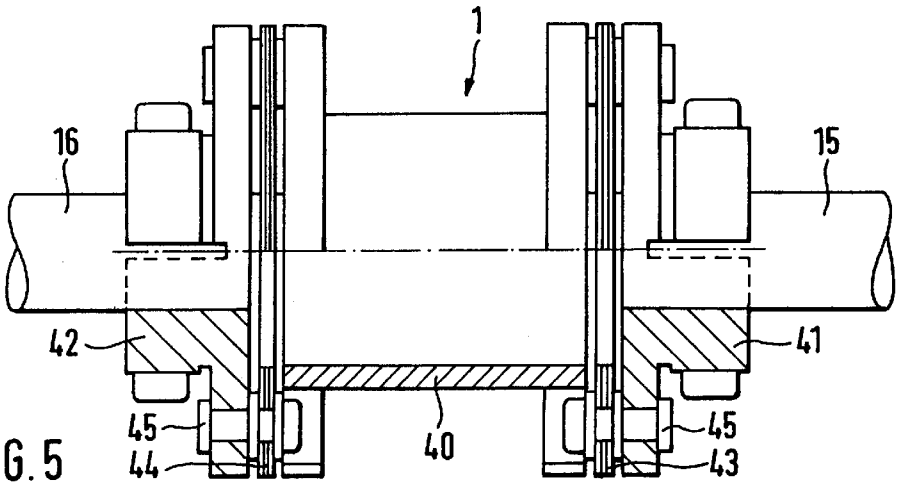
FIG. 5 is a view of a coupling.

In FIG. 5 a coupling 1 is shown. The coupling 1 is comprised of a midpiece 40, which joins flanges 41 and 42. In flange 41, the drive shaft 15 is installed. The roll axle 16 is affixed to flange 42. The connection is done respectively in a slip free manner. Between midpiece 40 and flange 41 or 42, respectively springs 43 and 44 are arranged.

These springs are connected to flange 41 and flange 42 with rods 45 in such a manner that the transmission of rotary motion can be carried out. Otherwise, an axial displacement of the flanges 41 and 42 with the respective shafts, that is, 15 and 16 is made possible. Several of the rods 45 with accompanying springs 43 or 44 are apportioned around the circumference of the flange. Some of the rods 45 are torsion tightened to the flanges 41 and 42, other rods are similarly torsionally tightened to the midpiece 40. Those rods 45 which are torsionally tightened with the flanges 41 and 42 are not secured into the midpiece, but essentially make the connection between the spring 43 or 44 with the flange 41 or 42 respectively. The other rods 45, which are connected with the midpiece 40, bind the springs 43 and 44 torsionally tightened to said midpiece 40 and are independent of the flange 41 or 42. It is by means of this arrangement that the axial displacement of the shafts 15 and 16 is made possible.

It will be apparent to those skilled in the art that various modifications and variations can be made in the present invention without departing from the scope and spirit of the invention. It is intended that the present invention include such modifications and variations as come within the scope of the appended claims and their equivalents.

I claim:

1. An apparatus for finishing of a fiber band wherein a thickness of the fiber band is determined, said apparatus comprising:

a pair of feeler rolls between which the fiber band passes, at least one of said feeler rolls radially movable in response to variations in thickness of the fiber band;

a shaft configured for driving at least one of said feeler rolls, said shaft further comprising a drive shaft and a feeler roll axle rotationally coupled to said drive shaft at one end and to said driven feeler roll; and a coupling device operationally disposed between said drive shaft and said feeler roll axle, said coupling configured to permit lateral movement between said drive shaft and said feeler roll axle within an acceptable predetermined range so that said feeler roll axle and said movable feeler roll are movable laterally relative to said drive shaft as a result of deflections of said feeler roll in response to changes in fiber band thickness.

2. The apparatus as in claim 1, further comprising a bearing assembly for each of said drive shaft and said feeler roll axle, said feeler roll axle bearing assembly movable with respect to said drive shaft bearing assembly at least in said acceptable predetermined range of misalignment between said drive shaft and said feeler roll axle.

3. The apparatus as in claim 2, further comprising a feeler roll bearing block and a drive shaft bearing block, said feeler roll axle bearing assembly arranged in said feeler roll bearing block and said drive shaft bearing assembly arranged in said drive shaft bearing block.

4. The apparatus as in claim 3, wherein said drive shaft bearing block pivots upon said feeler roll bearing block pivoting beyond said acceptable predetermined range of misalignment.

5. The apparatus as in claim 3, wherein said drive shaft bearing block has an eccentric thrust bar for pivotal movement thereof.

6. The apparatus as in claim 3, wherein said feeler roll bearing block is rotatably mounted on said drive shaft bearing block.

7. The apparatus as in claim 6, further comprising a pivotal axle by which said feeler roll bearing block pivots relative to said drive shaft bearing block, and by which said drive shaft bearing block pivots.

8. The apparatus as in claim 3, wherein said bearing blocks are mounted with slide bearings for adjustment thereof.

9. The apparatus as in claim 3, further comprising an automatic disconnect device disposed to detect pivoting of said drive shaft bearing block, said disconnect device generating a control signal to cause a shut down of a textile machine incorporating said apparatus.

10. The apparatus as in claim 3, wherein each of said bearing blocks are set to an initial position with a respective loading spring.

11. The apparatus as in claim 10, wherein said loading spring for said feeler roll bearing block is weaker than said loading spring for said drive shaft bearing block.

12. The apparatus as in claim 2, wherein said feeler roll axle bearing assembly comprises needle roller bearings.

13. The apparatus as in claim 1, further comprising a sensor disposed to measure displacement of said movable feeler roll as a measurement of fiber band thickness.

14. The apparatus as in claim 13, further comprising a pivotal bearing block for each of said drive shaft and said feeler roll axle, said feeler roll bearing block movable with respect to said drive shaft bearing block at least in said acceptable predetermined range of misalignment between said drive shaft and said feeler roll axle, said sensor disposed to detect movement of said feeler roll bearing block.

15. The apparatus as in claim 1, further comprising an adjusting mechanism for setting an initial spacing between said feeler rolls.

16. The apparatus as in claim 1, wherein said coupling device comprises a torsionally rigid and axially flexible shaft coupling.

17. The apparatus as in claim 16, wherein said coupling device comprises a multiple disk coupling.

18. The apparatus as in claim 1, wherein said movable feeler roll is press fitted onto said feeler roll axle.

19. The apparatus as in claim 1, wherein said movable feeler roll comprises a concave circumferential surface in which said fiber band runs.

20. The apparatus as in claim 19, wherein said movable feeler roll comprises weight reducing borings defined therein between said feeler roll axle and said circumferential surface, and said feeler roll axle is substantially hollow.

* * * * *